US006688261B2

(12) United States Patent
Smith et al.

(10) Patent No.: US 6,688,261 B2
(45) Date of Patent: Feb. 10, 2004

(54) HEATING SYSTEM FOR LIQUIDS

(75) Inventors: Douglas W. Smith, Calgary (CA); Bernard K. Deschner, Calgary (CA)

(73) Assignee: Conematic Heating Systems Inc., Calgary (CA)

( * ) Notice: Subject to any disclaimer, the term of this patent is extended or adjusted under 35 U.S.C. 154(b) by 0 days.

(21) Appl. No.: 10/217,418

(22) Filed: Aug. 14, 2002

(65) Prior Publication Data

US 2003/0155430 A1 Aug. 21, 2003

(51) Int. Cl.[7] ..... F22B 1/18

(52) U.S. Cl. ..... 122/155.1; 122/31.1; 122/367.1; 165/155

(58) Field of Search ..... 122/19.1, 15.1, 122/30, 31.1, 367.1, 367.3, 155.1, 155.2, 165, 166.1; 165/155, 157, 164, 147, 179, 901; 237/55

(56) References Cited

U.S. PATENT DOCUMENTS

| | | | | |
|---|---|---|---|---|
| 2,557,712 A | | 10/1947 | Wenger | |
| 3,060,921 A | | 10/1962 | Luring et al. | |
| 3,847,350 A | * | 11/1974 | Thompson | 237/8 A |
| 4,319,557 A | | 3/1982 | Sietmann et al. | |
| 4,357,909 A | | 11/1982 | Kagoshima | |
| 4,686,940 A | * | 8/1987 | Fullemann | 122/31.1 |
| 4,735,174 A | | 4/1988 | Crump | |
| 4,905,661 A | | 3/1990 | Wilson | |
| 5,228,513 A | | 7/1993 | Hemsath | |
| 5,361,751 A | | 11/1994 | Biggs | |
| 5,570,681 A | | 11/1996 | Kravets et al. | |
| 5,678,533 A | * | 10/1997 | Liljegren | 122/18.31 |
| 6,202,935 B1 | | 3/2001 | Akkala et al. | |
| 6,237,544 B1 | | 5/2001 | Croxford et al. | |
| 6,584,940 B1 | * | 7/2003 | Khadkikar et al. | 122/18.1 |

FOREIGN PATENT DOCUMENTS

| | | |
|---|---|---|
| CA | 322817 | 5/1932 |
| CA | 405431 | 6/1942 |
| CA | 473394 | 5/1951 |
| CA | 2089217 | 8/1994 |
| DE | 283567 | 6/1914 |
| FR | 596112 | 10/1925 |
| FR | 9415160 | 2/1996 |

OTHER PUBLICATIONS

Ace Boiler Inc., Ace Copper Fin Coil Heater; www.combustionsystems.com/ace7.html; Feb. 13, 2002.

Straight Talk About Boiler Efficiency; www.weil–mclain-.com/netdocs/straighttalk.htm; Feb. 13, 2002.

Cleaver Brooks; Evaluating Boiler Efficiency; www.cleaver–brooks.com/Service15.html; Feb. 13, 2002.

Cleaver Brooks; The Boiler Guide; www.cleaver–brooks.com/Boilersa 1.html.

(List continued on next page.)

*Primary Examiner*—Gregory Wilson
(74) *Attorney, Agent, or Firm*—Sean W. Goodwin

(57) ABSTRACT

A heater comprises an enhanced-surface area heat transfer vessel which is situated co-axially in a hot flue gas plenum. The plenum is formed by dual-wall heating jacket. Liquid flowing through the jacket is heated co-currently by the flue gas before the preheated liquid is conducted to the top of the vessel for countercurrent heat exchange therein before discharge from the bottom of the vessel. Hot flue gas flowing through the plenum is directed circumferentially by one or more spaced and perforated ring plates placed across the plenum annulus between the jacket and the vessel. Aluminum construction of the vessel and jacket with protective coatings contribute to a lightweight heater for either floor or even wall mounting. The heater is conveniently implemented in a hydronic heating system, a potable hot water system or a combination of both.

20 Claims, 9 Drawing Sheets

OTHER PUBLICATIONS

AEP: America's Energy Partner; Gas–side Fouling; www.aep.com/EnergyInfo/ethtml/ehubgsf.html; Feb. 13, 2002.

AEP: America's Energy Partner; Water–side Fouling; www.aep.com/EnergyInfo/et html/ehubwsf.htm; Feb. 13, 2002.

Smith Cast Iron Boilers, GV100 Boiler; www.smithboiler-.com/html/gv100.html; Feb. 2002.

Burnham America's Boiler Company; Spacemaster; www-.burnham.com Feb. 2002.

Raypak®; Hi Delta™; Catalog No. 1000.53A Models 122–322 Type H, WH&P; Feb. 2002.

Hot Water Express.com, Boilers; www.hotwaterexpress-.com/Boilers.htm; Feb. 13, 2002.

Hot Water Express.com; Boilers; How it works; www.hot-waterexpress.com/Works Boilers.htm; Feb. 13, 2002.

Why Hydronic Heating; www.peerless–heater.com/why hydronic heating.htm; Feb. 13, 2002.

* cited by examiner

HEATING SYSTEM FOR LIQUIDS

FIELD OF THE INVENTION

The present invention relates to liquid heaters having a burner to dispense hot combustion or flue gases which heat a finned heat exchange vessel filled with fluid, the flue gas being diverted about and through baffles to increase efficiency. More particularly the liquid is first preheated in a first stage in an outer jacket which is also exposed to the flue gases. Such a heater is applicable to hydronic heating systems and domestic water heating.

BACKGROUND OF THE INVENTION

Hydronic heating systems circulate hot water in a closed system comprising a water heater and a plurality of radiators. Sometimes consumable hot water is also obtained through heat exchange with the closed hydronic system.

Today, the most common of domestic water heaters comprise a pressure vessel having a cylindrical wall, a hemispherical top and a concave, hemispherical bottom which is directly exposed to a gas or oil burner. The effective heat exchange surface is substantially limited to the hemispherical base. The vessel also has a central flue for discharge of flue gases and some recapture of the heat from the hot flue gases. A cool water inlet is located near the base of the vessel. The water in the vessel is heated and the resulting hot water rises to the top of the vessel for extraction on demand. The vessel is insulated along its cylindrical portion to reduce heat loss during standby periods. The efficiency of such a hot water vessel is not particularly high.

In systems having a larger heat demand, such as those used for heating living space, it is conventional to use boilers and heat exchanger furnaces which utilize large surface heat transfer areas by providing a plurality of tubes either through which or around which combustion gases pass for delivering up their heat to the heat transfer fluid on the opposing side of the tubes. Tubes are often linearly extending between opposing heads or are coiled to minimize space and maximize surface area. There are many connective joints, relatively fragile materials of construction and many opportunities for failure and resulting expensive repairs.

In the past and out of favor today due to low efficiencies, a water heater was introduced which utilized a ribbed, inverted cone-shaped water reservoir which was enclosed in an outer cylindrical casing. Such a heater is specifically set forth in Canadian patents 405,431 in 1942 and CA 473,394 in 1952, both to Wenger. An annular plenum having an upwardly diminishing cross-sectional area was formed between the conical reservoir and the casing through which flue gases were conducted for heating the reservoir. As in typical hot water heaters, cool water was introduced at the base of the reservoir and hot water was removed from the top of the reservoir. The reservoir was ribbed and heat transfer occurred substantially through conduction of heat to the reservoir from the hot flue gases passing in a co-current flow upwardly through the plenum to the reservoir's sidewall. Hot flue gases were vented from the plenum. While successful due to their simplicity and reliability, their efficiencies became unacceptable, and eventually their use diminished. The use of coiled tubing boilers is associated with high cost and expensive repairs but have relatively high efficiencies. The cone type heaters of Wenger were inexpensive, associated with low maintenance but have only low efficiencies. These disadvantages of the prior art systems are believed to be resolved by the water heater of the present invention.

SUMMARY OF THE INVENTION

In one aspect of the present invention, a heater is provided for supplying hot water in a heating system. The heater comprises a combination of a low-maintenance, enhanced-surface area heat transfer vessel which is situated in an annular hot flue gas plenum. In a preferred arrangement using a supplemental and first stage dual-wall heating jacket, efficiency is increased so as to be comparable to more sophisticated, expensive and higher maintenance systems of the prior art. Hot flue gas flowing through the plenum is directed circumferentially by one or more perforated ring plates for enhanced convective heat transfer about the vessel.

In a broad aspect of the invention, the heater comprises: a housing having a base and an upper exhaust end for forming a plenum which conducts a flow of hot flue gas from a burner positioned adjacent the housing's base; a heat transfer vessel having a substantially conical body with a closed tip and a closed top, the body residing substantially coaxially within the plenum so as to form an annular space therebetween through which hot flue gases upwardly flow to the exhaust end, the tip of the body being oriented closest to the burner and having side walls diverging upwardly towards the plenum's exhaust end; an inlet adjacent the vessel top and a vessel outlet adjacent the vessel tip so that the liquid flows downwardly and countercurrent to the hot flue gas and is heated before being discharged from the vessel; and one or more annular plates located transverse across the annular space for at least partially distributing the hot flue gas about the vessel as they pass upwardly by the one or more annular plates. It is preferred to insulate the housing for this embodiment, the housing quickly achieving flue gas temperatures.

Preferably, the annular plates contain a plurality of openings therethrough, at least some of which are louvered forming baffles for urging the flue gas to circulate about the vessel. Where two or more plates are used, the baffles can be oriented in the same circumferential direction or in alternately opposite directions.

More preferably, the heater can be fitted with a preheating jacket containing the liquid for preheating it before directing to the vessel. The jacket accepts even more heat from the hot flue gas and results serendipitously in a lower outside jacket temperature which may not even require thermal insulation in when the feed liquid enters the heater at ambient temperatures. The annular jacket comprises inner and outer walls which are closed at a lower and an upper end and forming an annular cross-sectional space therebetween, the inner wall forming the housing and which is in heat conductive communication with the hot flue gases in the plenum; an inlet at the jacket's lower end and an outlet at the jacket's upper end so that liquid can flow from the inlet to the outlet and be preheated before discharge into the vessel's inlet.

In another broad aspect, the preheater jacket can be combined with any of a variety of heat exchanger for convenient and more effective use of the hot flue gases. Further improvement in efficiency can be obtained by adding one or more annular plates.

BRIEF DESCRIPTION OF THE DRAWINGS

FIG. 5*a* illustrates each annular plate inducing the same direction of flow and FIG. 5*b* illustrates inducing of alternating directions of flow;

DETAILED DESCRIPTION OF THE PREFERRED EMBODIMENT

Figure 1:
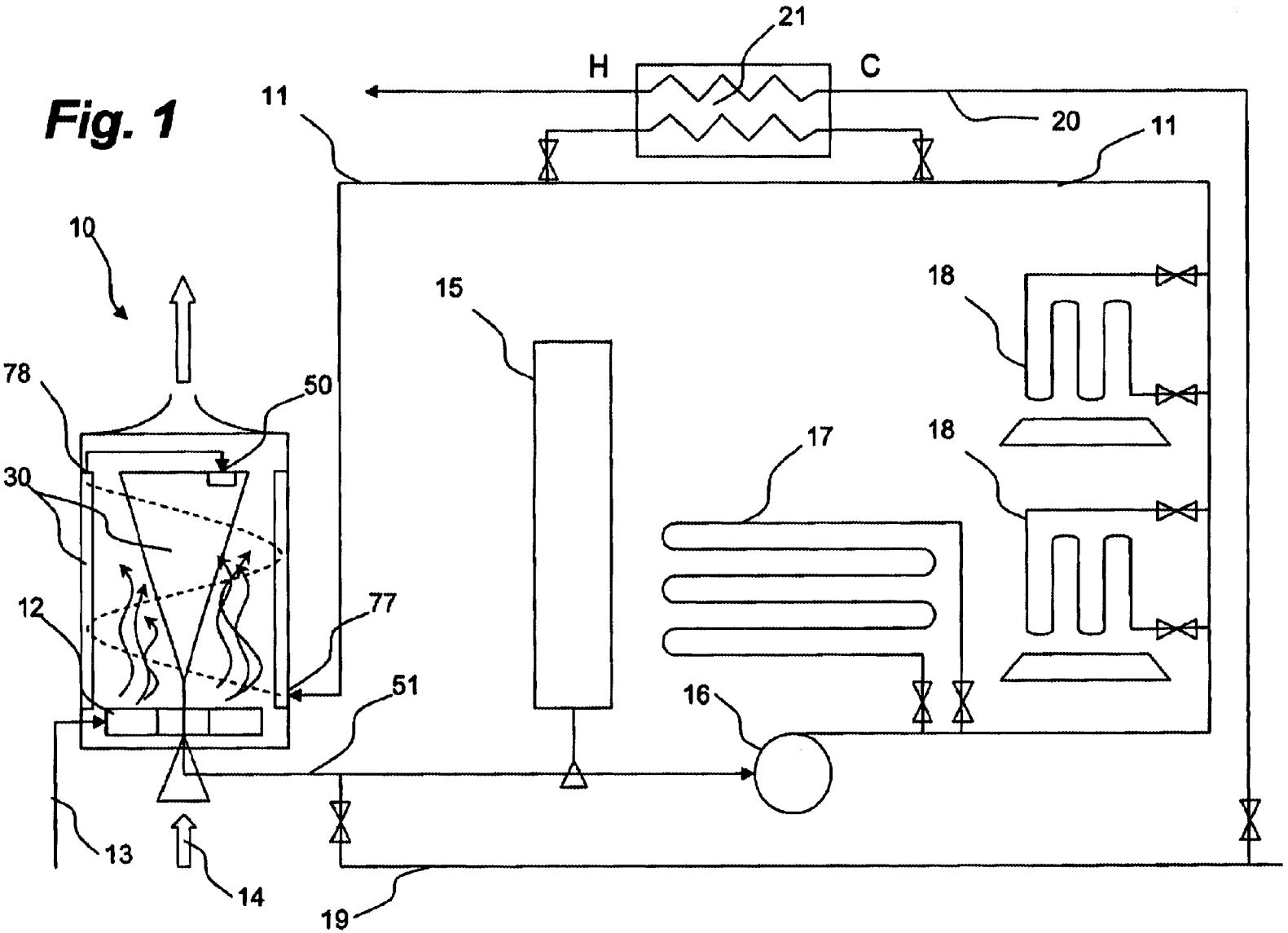
FIG. 1 is a schematic view of a combined space heating and potable water heating system integrating a heater of the present invention.

With reference to FIG. 1, a heater 10 is provided in a system for heating liquids. Herein, several embodiments are described one of which includes a closed system such as a hydronic heating system which heats a first liquid in the heater which is usually recirculated as hot liquid in a domestic water heating system. In another embodiment. the heater heats a first fluid in a closed system for indirect heating of a second liquid. An example of such a system comprises heating liquid, glycol or water for instance, in the heater and passing this heated liquid through a heat exchanger for heating potable water as the second liquid.

The heater can be part of a heating system or can used independently for heating the designated liquid.

As shown in FIG. 1, in a typical hydronic domestic heating situation, an embodiment of the heater 10 of the present invention is part of a closed heating loop 11 which circulates a liquid such as water and the heat transfer medium. The heater comprises a heat exchanger portion 30 (described in detail below) and a burner 12 which bums a mixture of fuel 13 and air 14 and emits a hot flue gas 35. The heater accepts cooled water and produces hot water for reintroduction to the closed heating loop 11. The loop has a make-up water source 19. The loop also comprises an expansion tank 15 and a circulation pump 16. The loop 11 delivers hot water to a plurality of heating devices or radiators such as convectors, fan coils and floor heating tubing 17 or room radiators 18 as depicted in FIG. 1.

A potable water heating loop circuit is also illustrated. Potable water 20 is directed through a conventional liquid to liquid heat exchanger 21 for transferring heat from the loop 11 to the potable water 20. The heat exchange 21 has two chambers in thermal communication, a first in liquid communication with the hot water in the loop 11 and a second in communication with a supply of potable water 20.

Figure 2:
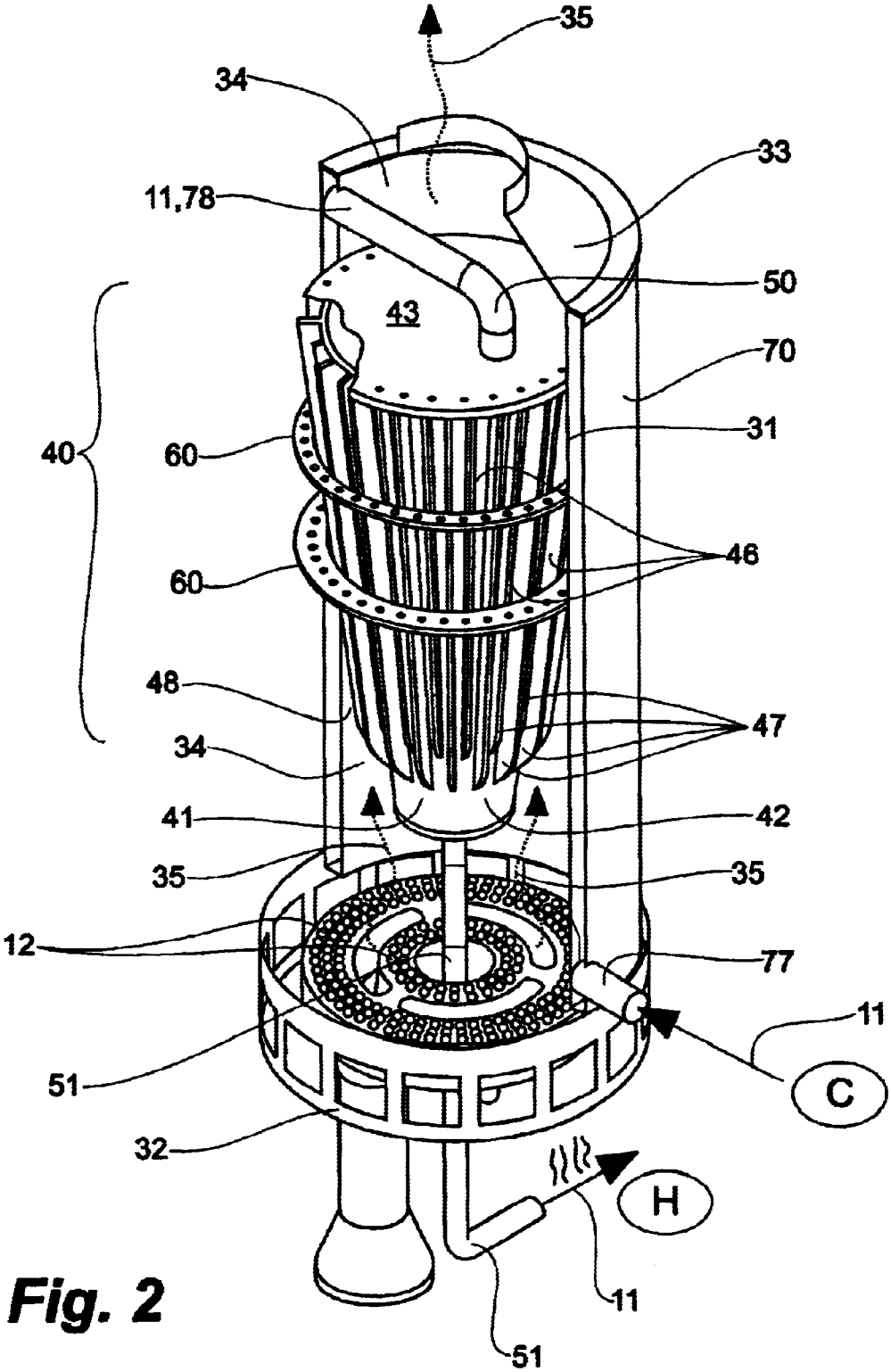
FIG. 2 is an isometric view of a conical vessel positioned in a plenum according to one embodiment of the invention.

In greater detail, and with reference to FIG. 2, in a first standalone embodiment, the heater 10 comprises a cylindrical housing 31 having a base 32 and an upper exhaust end 33. One or more burners 12 are positioned in the base 32 of the housing 31. The housing 31 forms a plenum 34 for conducting products of combustion, or hot flue gas 35, to the exhaust end 33.

A suitable burner is a naturally aspirated, low pressure gas burner. As shown in FIG. 1, the burner comprises one or more annular burner heads having a multiplicity of ports for emitting a combustible gas/air mixture. Those of skill in the art are knowledgeable and capable of providing the associated combination of the type of gas, the gas pressure, the size of orifice and number and size of burner head ports required to effect efficient combustion. The top exhaust also produces enough draft to draw the hot flue gases and prevent bum back. The burner heads are spaced beneath from the body's tip end. By spacing the burners 12 below the vessel 40 so that the air and fuel mix before reaching the vessel heat exchanger, the flue gases are not dissuaded from intimate contact with the vessel.

A heat transfer vessel 40 is suspended in the housing 31 for receiving heat from the burners 12 and hot flue gas 35.

There are a variety of heat transfer vessels which can be applied. Use of an enhanced surface unitary body vessel has simplicity as an advantage. Coiled heat exchangers. have the advantage of greater surface area. Use of a coiled heat exchanger in combination with a preheater jacket is described in greater detail below.

In one embodiment, the vessel 40 has a substantially conical body 41 with a closed tip 42 and a closed top 43. The vessel 40 is located substantially coaxially within the plenum 34 so as to being in contact with hot flue gases 35 across the surface of the vessel 40. The body's tip 42 is oriented closest to the base 32. Accordingly, the body has side walls 46 that diverge upwardly towards the plenum's exhaust end 33. The body's side walls 46 are fitted with a plurality of heat transfer fins 47. The fins 47 are shown extending axially along the body's side walls. While they can be more challenging to manufacture, the fins 47 can also be formed in other orientations such as circumferentially or helically about the vessel's body 41.

An annular space 48 is formed between the vessel's body 41 and the housing 31 for enabling the hot flue gases 35 to flow from the burners 12, past the vessel 40 and to the housing's exhaust end 33. The housing can be cylindrical and the cross-section of the annular space diminishes upwardly to a minimum at about the body's top end 43. A constriction between the vessel's top end 43 and the housing 31 at the top of the annular space 48 has been found to assist in creating a draft for the flue gas, aiding in combustion.

The vessel 40 has an inlet 50 adjacent the top 43 of the conical body 41 for the entry of relatively cool liquid the vessel. An outlet 51 is located adjacent the tip 42 of the conical body 41 for the discharge of heated liquid from the vessel. Accordingly, and in contradistinction to conventional water heaters, the liquid flows in the inlet 50, downwardly through the vessel 40 and out of the outlet 51, while the flue gas 35 rises and flows upwardly past the vessel 40; the ;liquid and gases establishing a countercurrent heat exchange.

Figure 3A:
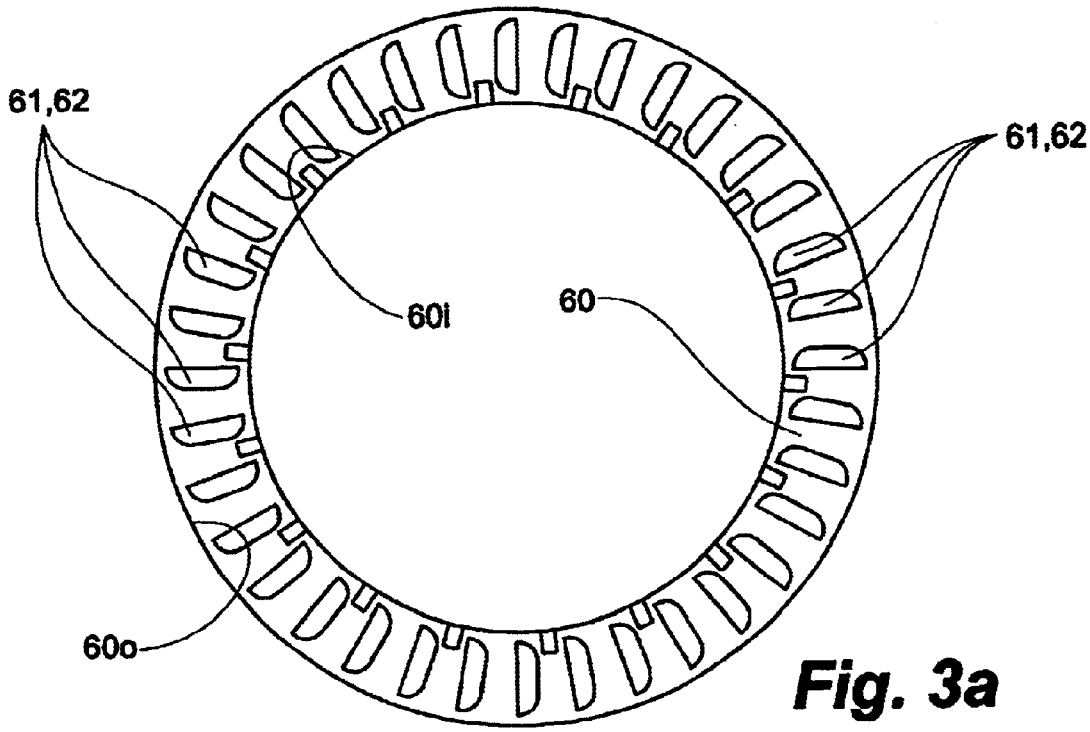
FIGS. 3*a* and 3*b* are two styles of annular plates having a plurality of baffles formed therein, about 36 baffles in the top plate of FIG. 3*a*, and about 55 baffles and an additional 9 non-baffled openings in FIG. 3*b;*
Figure 3B:
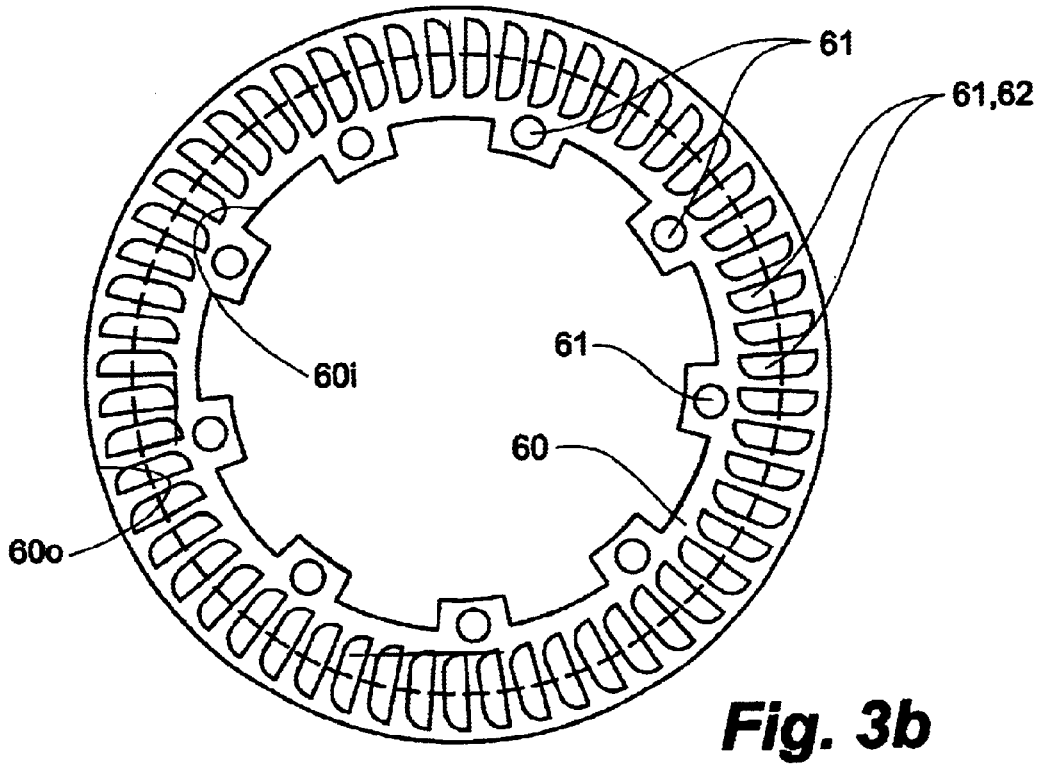

Having reference to FIGS. 2, 3*a* and 3*b*, one or more annular plates 60 are located transversely across the annular space 48. Each plate 60 has a plurality of openings 61 formed therein for enabling hot flue gases 35 to pass therethrough.

Figure 4:
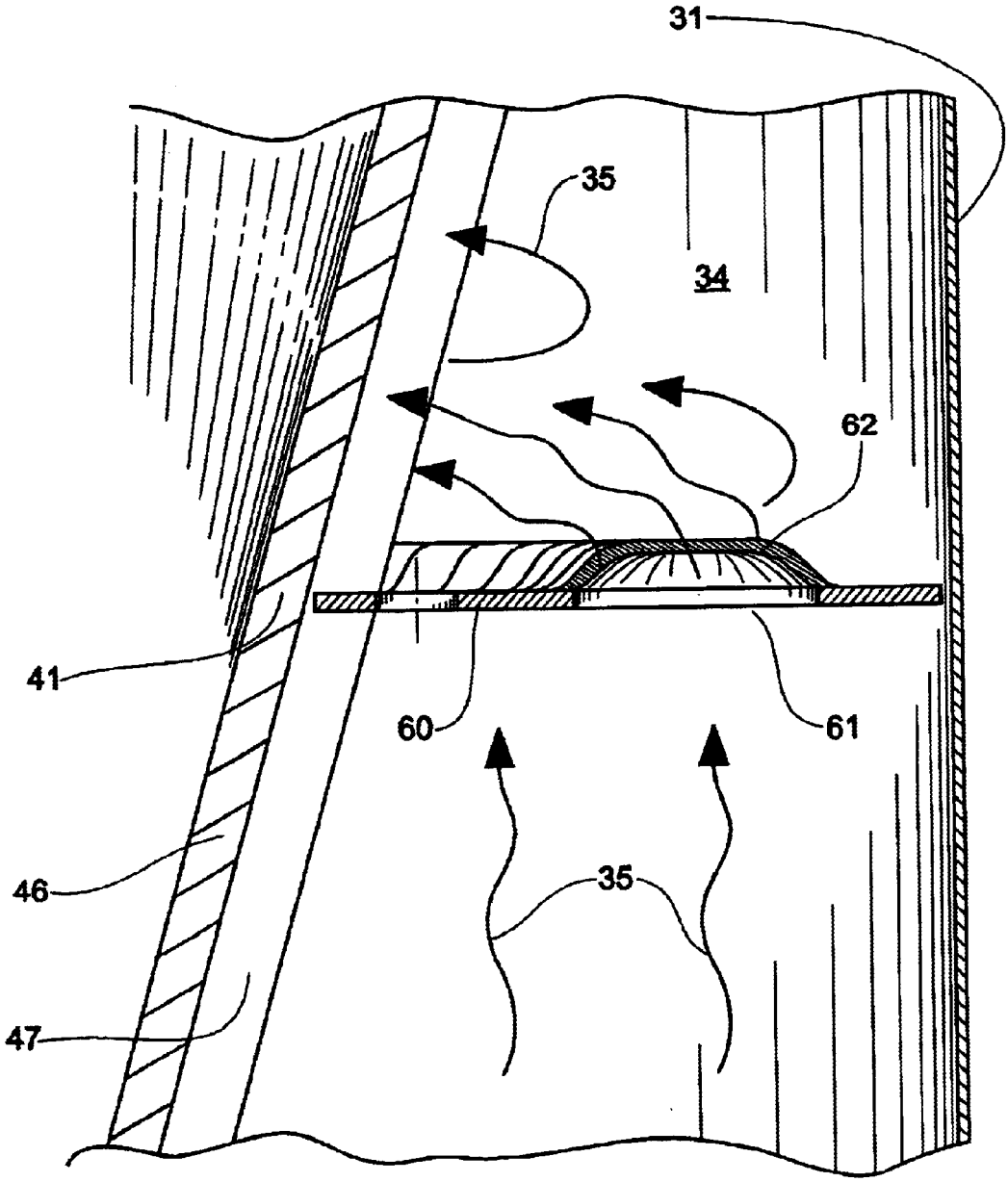
FIG. 4 is a side cross-sectional view of a portion of a side wall of the vessel and a radial portion of an annular plate with a representation of the flow of hot flue gas through a plurality of baffles.

With reference to FIGS. 3*a*–5*b*, in an alternate embodiment, at least some of the openings 61 are fitted with louvers or baffles 62 for diverting the flue gas 35 laterally. As shown in FIGS. 3 and 4, the baffles 62 extend laterally across the openings. By orienting all of the baffles circumferentially, and in the same direction, the flue gases can be induced to move somewhat circumferentially and thus swirl about the vessel 40 as they flow up the plenum 34 to the top exhaust 33. The plates 60 have an inner periphery 60*i* and an outer periphery 60*o*, each of which is sized to the body 41 and housing 31 respectively so that flue gas 35 is urged to flow through the plate's openings 61 and in the case of baffles 62, to be urged to spiral up the annular space 48.

The plate's openings 61 are generally uniformly arranged circumferentially about the plates 60 so that hot flue gases 35 are substantially evenly distributed about the plenum.

Figure 5B:
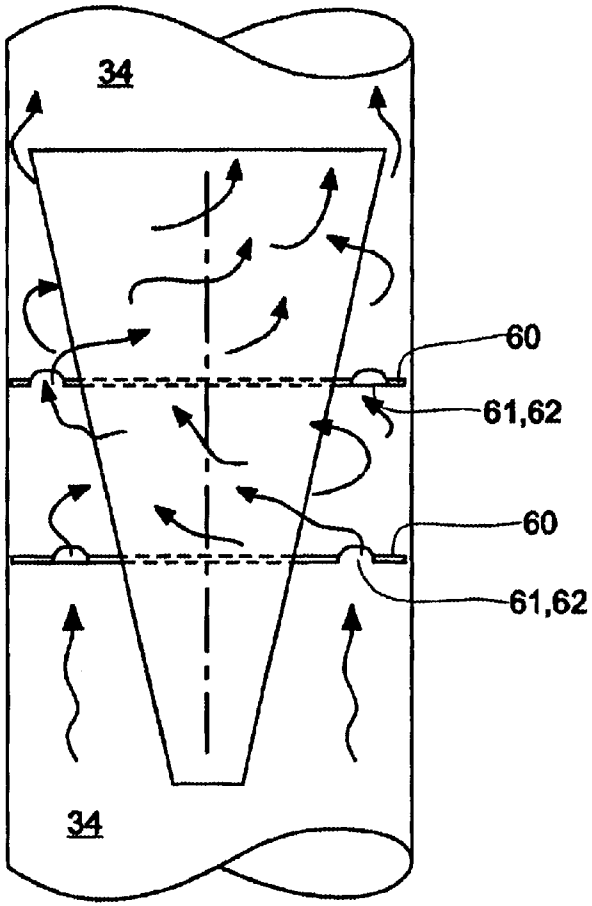
FIGS. 5*a* and 5*b* are schematic views illustrating a vessel in its plenum and having a pair of annular plates and baffles which induce circumferential flow of the hot flue gas about the vessel.
Figure 5A:
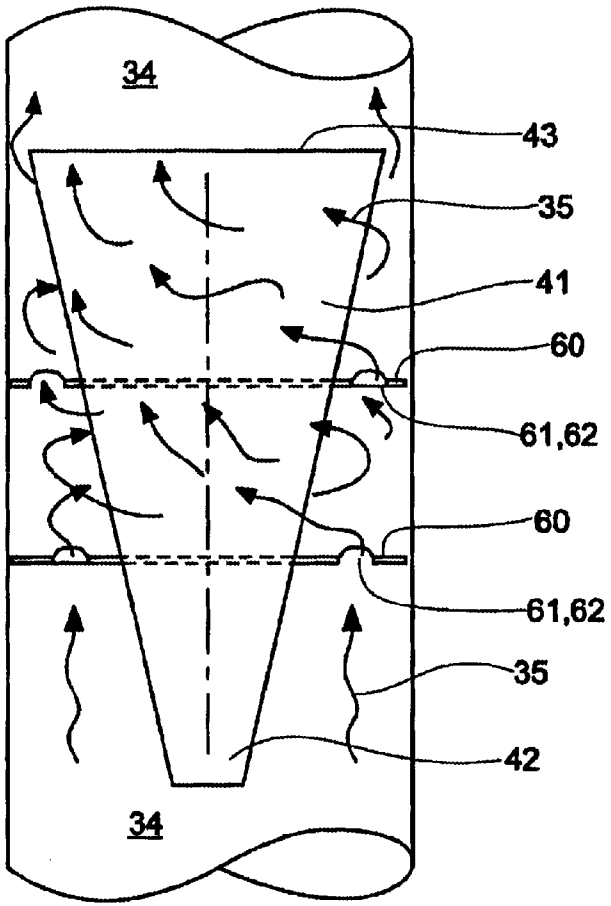

With reference to FIGS. 5*a* and 5*b*, use of more than one plate 60 having baffles 62, permits control over the movement of the hot flue gas. The plates are spaced vertically apart and successive plates with baffles having the same orientation can re-induce the flue gas to move in the same direction (FIG. 5*a*). Successive plates with baffles having alternating and opposing orientation will induce the flue gas to move in opposing directions (FIG. 5*b*).

The one or more annular plates 60 are spaced vertically along the vessel 40. The lowest of the plates 60 is positioned sufficiently above the burner so as to minimally impinge on the burner's combustion process.

Cooler water enters the vessel at the upper inlet 50, is heated by conduction through the body side walls and flows as hot water out of the lower outlet 51. Additional heating is possible using the housing itself to recover heat from the burner and hot flue gas.

When used as a single stage of heating, the housing is preferably insulated for safety and heat conservations purposes.

In another embodiment, the housing 31 itself formed into an annular water jacket 70. The jacket is a preheater stage for the liquid. It is conceivable that the jacket may not even require insulation as the incoming feed water, though the liquid therein is undergoing a heating process, may not require insulation on its periphery. Applicant is not aware of a heater provided with such a preheater jacket, regardless of the form of the main boiler or heat exchanger portion.

The jacket has a cylindrical inner wall 71 which forms the housing 31 for the vessel 40 and which is in heat conductive communication with the hot flue gases 35 in the plenum 34. A cylindrical outer wall 72 is positioned concentrically around the inner wall for forming an annular cross-sectional space 73 therebetween. The annular space 73 is closed at a lower end 74 and at an upper end 75 for forming a water chamber 76.

A liquid inlet 77 is formed at the outer wall 72 of jacket's lower end 74 for admitting feed liquid and an outlet 78 is formed at the inner wall 71 at the jacket's upper end 75 for conducting preheated liquid to the vessel's inlet 50. Optionally, to better distribute the incoming feed water from the inlet 77 and circumferentially about the jacket 70, it may be advantageous to utilize means such as an annular baffle 79 situated in the annular space between the inner and outer walls 71,72.

Figure 7A:
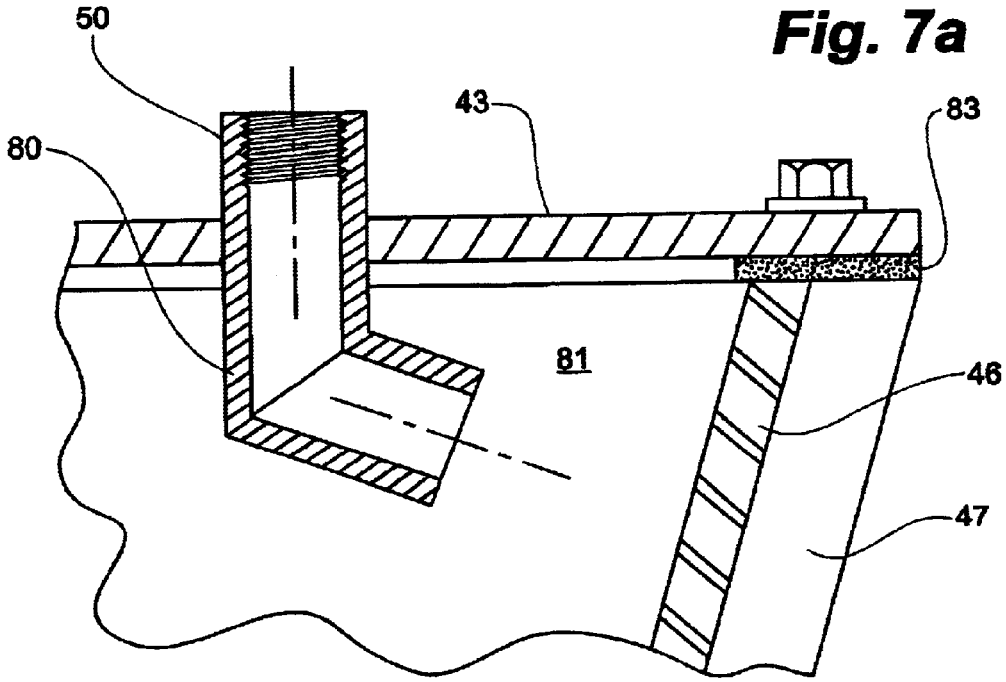
FIGS. 7*a* and 7*b* are partial cross-sectional side and plan views of the vessel's top and the inlet and liquid discharge to the vessel.
Figure 7B:
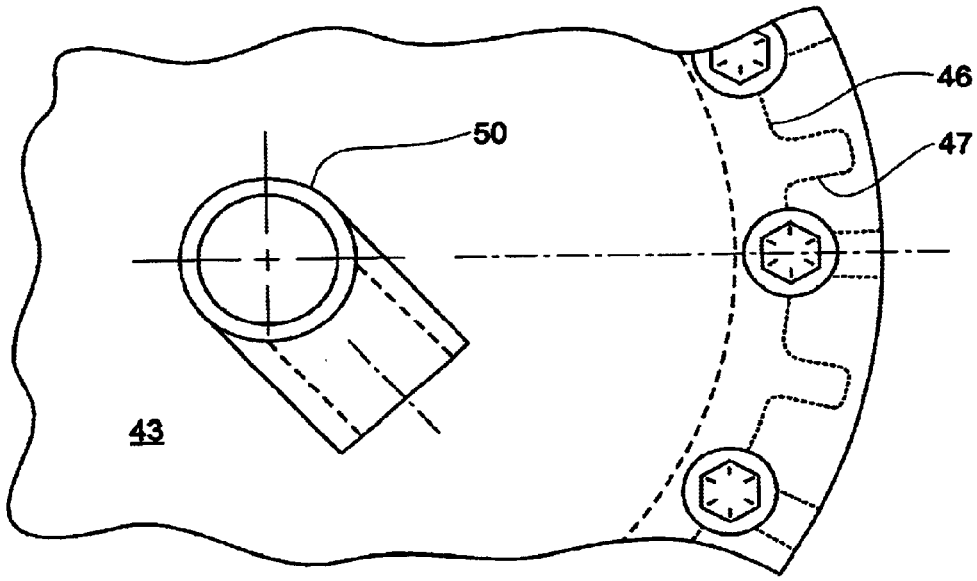

With reference to FIG. 7, vessel inlet 50 is fitted with a discharge 80 into the interior 81 of the vessel's body 41. The discharge 80 is oriented slightly downward (FIG. 7*a*) and at an angle to the side wall (FIG. 7*b*) so as to induce a spiraling and preferably turbulent movement of the water as it flows downwardly through the vessel 40. The inlet 50 is located adjacent a side wall 46.

As shown in FIG. 1 the heater 10 is part of a space heating system. The system is fitted with safety features such as thermocouple auto shutoff and pressure relief valves.

Figure 9:
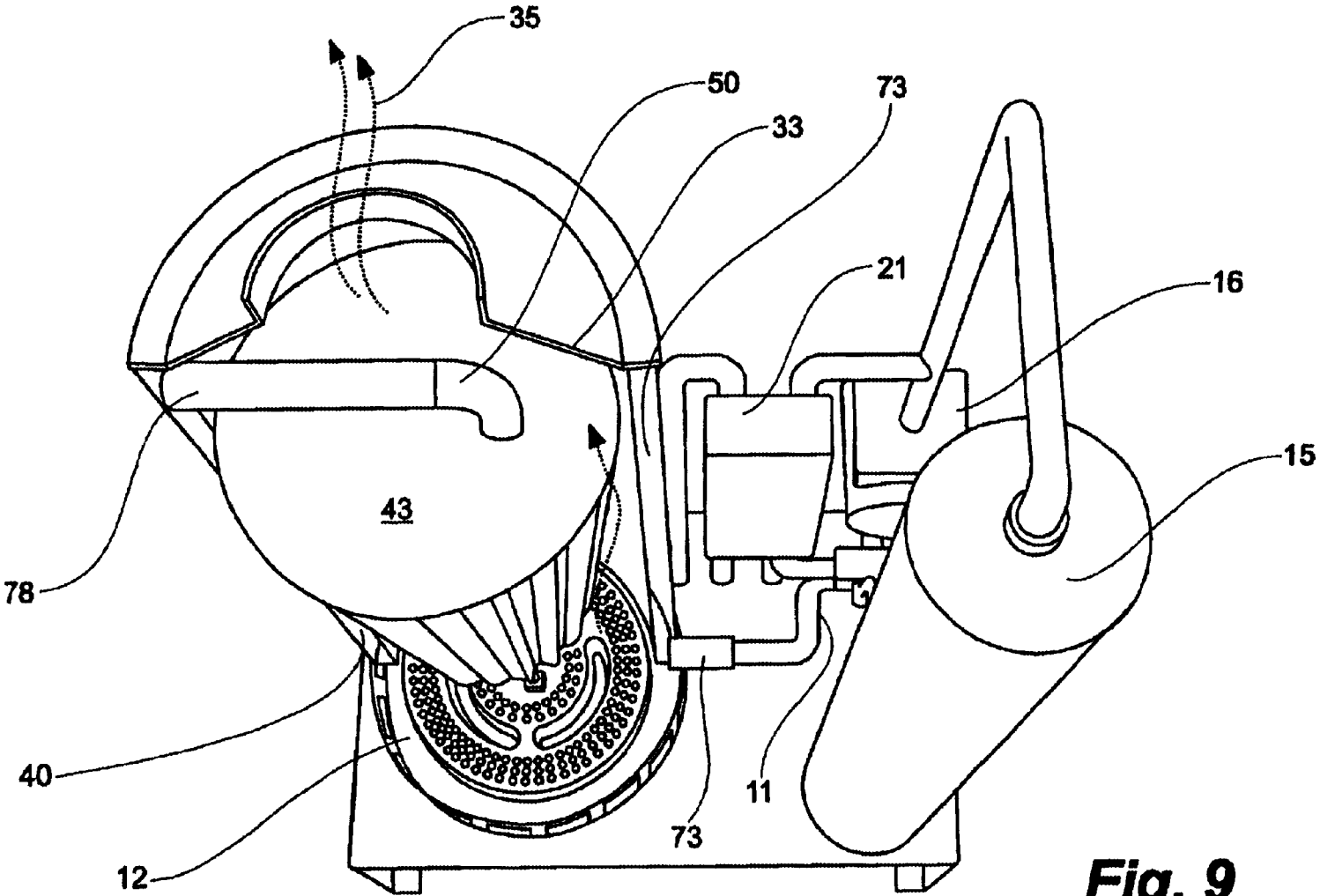
FIG. 9 is a top perspective view of a hydronic system implementing a heater of the present invention suitable for integration with the loop of FIG. 1.

With reference to FIG. 9, a heater is incorporated in a package which includes the expansion tank 15, the pump 16. A potable hot water heater 21 is also tied into the loop 11 immediately adjacent to the pump 16. Accordingly, the heater package can be applied for heating a product liquid such as for heating potable hot water directly. In a more versatile system, the heat heats a primary liquid such as water or glycol which is supplied to one or more radiators and to a heat exchanger for a secondary liquid such as for heating potable water.

EXAMPLE

Figure 6:
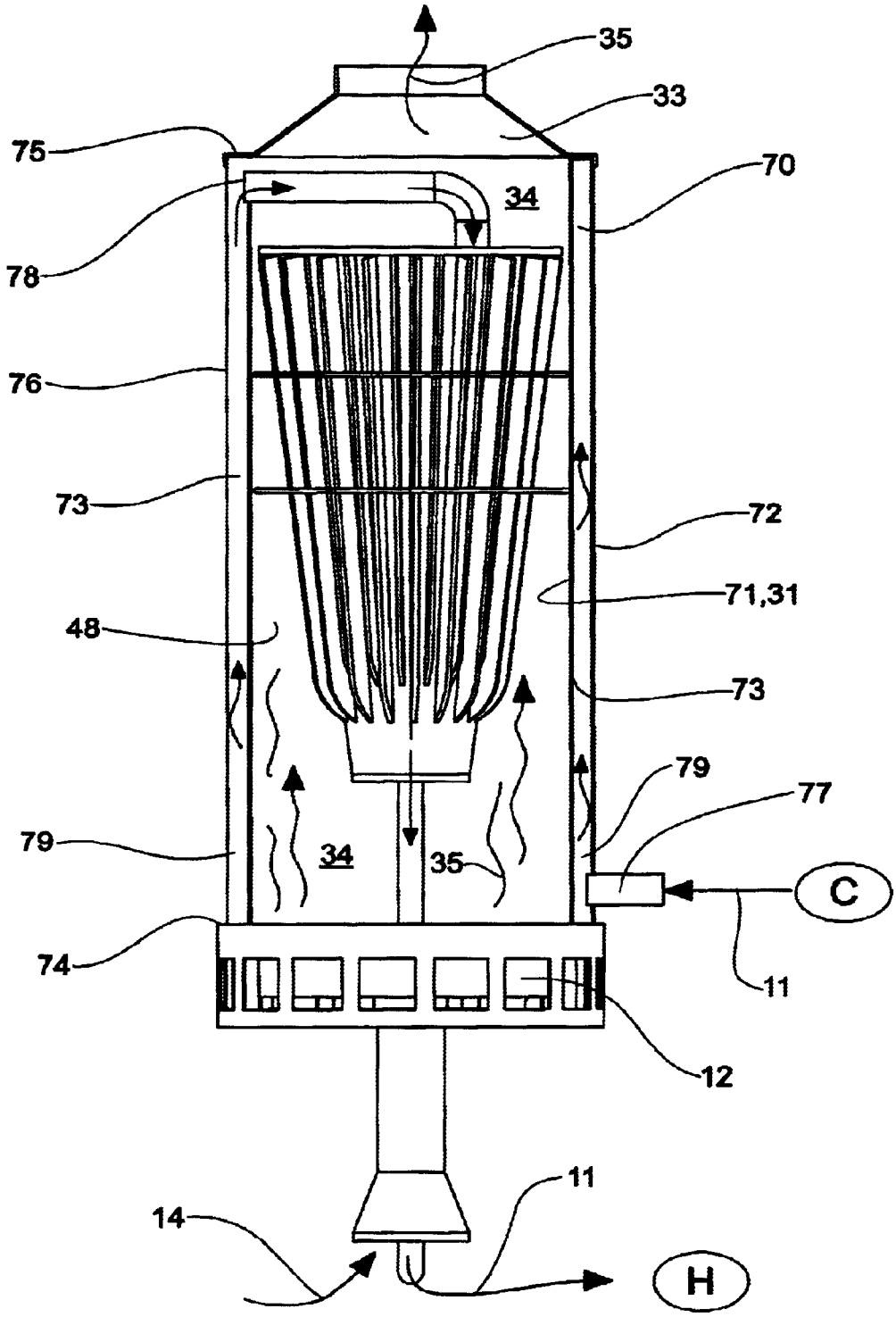
FIG. 6 is a side, cross-section view of the heating vessel and water jacket and illustrating a schematic of a preferred flow of liquid through the heater which includes a preheating jacket.

A lightweight heater according to an embodiment of the invention as show in FIG. 6, was constructed and various performance tests were conducted thereon. The body's side walls were formed of nominally 3/16" thick cast alloy aluminum with vertically oriented fins incorporated into the side walls; the fins alternating between ¾" tall and ½". The vessel 40 was 14" tall with a top end 43 formed of a cast aluminum plate about 8" in diameter. The jacket 70 was constructed of rolled aluminum with the inner wall and housing 71,31 being about 8½" in diameter forming an annular gap around between the vessel's top end 43 and the inner wall 71 of about ¼".

The vessel's inlet 50 was fitted with a ¾" pipe discharge angled downwardly at about 15° and angled from the side wall 46 at about 45°. As shown in FIG. 7*a*, the vessel's top end 43 was sealed using a gasket 83 and secured to the body 41 with a plurality of fasteners. Nominal operating pressure rating for the vessel was about 18 psig.

The vessel's cast components were treated inside and out. A smooth and non-reactive coating of high temperature single-part epoxy paint was added to the inside of the vessel for exposure to the heat transfer fluid; in the example case the fluid was water. Various epoxy formulations are possible and persons skilled in the art are aware of those enhanced for heat transfer such as composition and color. The outside was first treated with sodium meta-silicate under vacuum (cleaning and reduction of casing porosity) prior to applying a high temperature resistant and anti-corrosive mica-zinc coating (available from Corning). The liquid side of the jacket inner and outer walls were also coated with the epoxy paint. The cylindrical jacket components can be manufactured of rolled aluminum.

The burners produced nominal heat output of 35000–55000 Btu/hr as natural gas burners operating on 3–5" water column gas source and combustion air being naturally aspirated. Aluminum burner heats aid in maintaining an exceptionally light overall heater weight.

The annular plates were stainless steel. Tests were performed with and without the plates and with one or two plates installed.

Tests were performed, only some of which are illustrated herein. Objectives for the particular heater 10 were to achieve efficiencies greater that 80% with carbon monoxide levels below 200 ppm and flue gas exhaust temperatures of less than about 200–250° C. Different heaters and burners can alter the objectives and particularly the flue gas temperatures which could still higher yet while still achieving high efficiencies.

Tests presented herein illustrate a large improvement in efficiency from the prior art co-current conical vessel and once the objectives were obtained, further variation only resulted in minimal changes in performance between the various embodiments. Water flow rates ranged from 1.8–2.2. Combustion was tested with a Bacharach Model 300 analyzer. The tests were conducted at 1200 m above sea level. A thermal load was placed across the hot outlet and cool inlet to the heater to form a differential temperature.

Figure 8A:
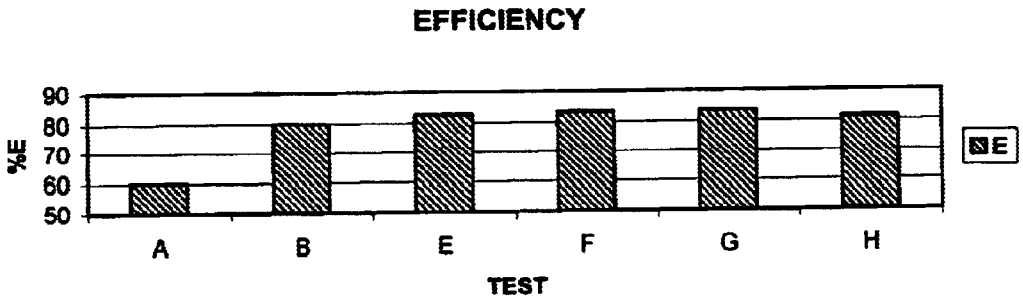
FIGS. 8*a*–8*c* are charts illustrating the improvement in heating efficiency by applying various embodiments of the present invention.
Figure 8B:
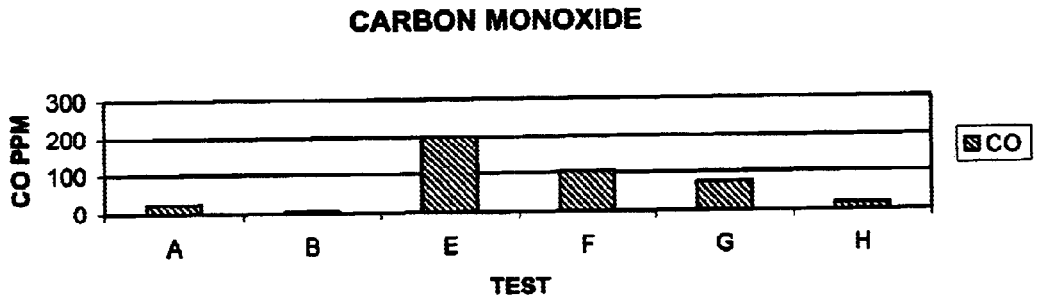
Figure 8C:
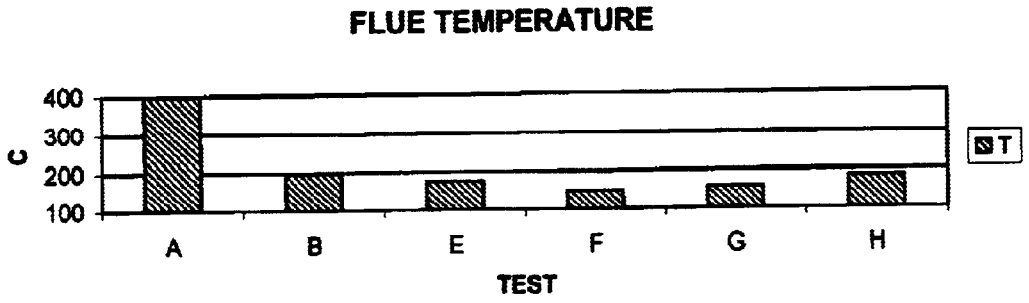

As shown in Table 1 and FIGS. 8*a*–8*c*, the results included:

| | Water flow Gpm | Load ΔT ° C. | BTU/hr | Efficiency % | CO ppm | Flue T ° C. | Status |
|---|---|---|---|---|---|---|---|
| A | 1.8 | 40 | 46150 | 60 | 25 | 398 | No Plates |
| B | 2.2 | 30 | 42000 | 80 | 6 | 198 | Single Plate |
| E | 2.2 | 40 | 48000 | 82.6 | 201 | 178 | Single Plate |
| F | 2.2 | 35 | 55000 | 83.1 | 104 | 149 | Two Plates |
| G | 2.2 | 33 | 45000 | 83.2 | 72 | 159 | Two Plates |
| H | 2.2 | 30 | 42000 | 81 | 17 | 184 | Two Plates |

In the case of a single plate, the annular plate was located about 5" from the top 43 of the 14" vessel 40. In the case of two plates, the second annular plate was spaced about 9" from the top of the vessel, or 4 more inches from the first baffle and about 12 inches above the burners to minimize flame impingement and ensure substantially complete combustion was achieved. Typical temperatures for a test were about 140° C. at the jacket inlet 77, 160° C. at the jacket outlet 78 to the vessel inlet 50, and about 180° C. exiting at the vessel outlet 51 with the thermal load taking out about 40° C.

The heater can be used as a new installation or as a retrofit. While the light, small and maintenance free operation is particularly appreciated in domestic service, the heat is just as adaptable to commercial operations. The vessel and jacket are less sensitive to hard water operations than are the coil-type boilers.

Whereas a preferred embodiment of the invention has been shown and described herein, it will be apparent that many modifications, alterations and variations may be made within the intended broad scope of the invention as defined in the appended claims. For example, whereas the cylindrical shape of the housing or of the conical shape of the vessel is preferred, other shapes or cross-sections can be implemented.

What is claimed is:

1. A heater for heating liquids comprising:

a housing having a base and an upper exhaust end for forming a plenum which conducts a flow of hot flue gas from a burner positioned adjacent the housing's base;

a heat transfer vessel having a substantially conical body with a closed tip and a closed top, the body residing substantially coaxially within the plenum so as to form an annular space therebetween through which hot flue gases upwardly flow to the exhaust end, the tip of the body being oriented closest to the burner and having side walls diverging upwardly towards the plenum's exhaust end;

a vessel inlet adjacent the top of the conical body for the entry of liquid to the vessel;

a vessel outlet adjacent the tip of the conical body so that the liquid flows downwardly and countercurrent to the hot flue gas and is heated before being discharged from the vessel; and one or more annular plates located transverse across the annular space for at least partially distributing the hot flue gas about the vessel as they pass upwardly by the one or more annular plates.

2. The heater of claim 1 wherein the body comprises conical side walls having heat transfer enhancing fins formed thereon and extending radially and between the body's tip and top.

3. The heater of claim 1 wherein the annular plates comprise openings, at least some of which have baffles for inducing the flue gas to swirl about the vessel as they flow through the baffles.

4. The heater of claim 1 wherein said one or more annular plates substantially fill the cross-section of the annular space between the body and the housing, each plate having one or more openings therethrough and at least some of the openings having baffles which are oriented such that hot flue gases flowing up the annular space are directed substantially circumferentially.

5. The heater of claim 4 wherein the lowest of the one or more plates is spaced sufficiently above the burner to permit substantially complete combustion by the burner.

6. The heater of claim 4 wherein inner and outer peripheries of the annular plates are sized to fit to the body and housing respectively so that substantially all flue gas is directed through the openings.

7. The heater of claim 6 wherein said openings are generally uniformly arranged circumferentially about said annular whereby said combustion gases are substantially evenly distributed about the plenum.

8. The heater of claim 7 further comprising two or more annular plates, the baffled openings of each plate being oriented in the same direction, each causing the flue gas to move in the same circumferential direction through the plenum and about the vessel.

9. The heater of claim 7 further comprising two or more annular plates, the baffled openings of successive annular plates being oriented in opposing directions for alternately reversing the circumferential direction of the hot flue gases through the plenum.

10. The heater of claim 2 wherein the burner is naturally aspirated.

11. The heater of claim 2 wherein the burner comprises one or more annular burners spaced beneath and radially outwards from the tip end of vessel.

12. The heater of claim 1 wherein the housing is cylindrical whereby the cross-section of the annular space diminishes upwardly to the top end of the vessel.

13. The heater of claim 1 further comprising:

an annular jacket having inner and outer walls which are closed at a lower and an upper end and forming an annular cross-sectional space therebetween, the inner wall forming the housing and which is in heat conductive communication with the hot flue gases in the plenum;

an inlet at the jacket's lower end for admitting feed liquid to the jacket; and an outlet at the jacket's upper end so that liquid can flow from the inlet to the outlet and be preheated by through the inner wall before the preheated liquid is conducted from the jacket to the vessel's inlet.

14. The heater of claim 13 wherein means are situated in the annular space between the inner and outer walls for distributing the feed liquid circumferentially about the jacket as it flows to the jacket outlet.

15. The heater of claim 14 wherein the housing and inner wall of the jacket are cylindrical.

16. The heater of claim 15 wherein the distributor means comprises an annular baffle situated in the jacket's annular space adjacent and above the jacket's inlet.

17. The heater of claim 13 wherein a first liquid flows through the heater in a closed loop for supply of hot water to one or more heating devices on the loop.

18. The heater of claim 16 further comprising a liquid to liquid heat exchanger having a first chamber in thermal communication with the loop and a second chamber in communication with a supply of potable water.

19. A heater for heating liquids comprising:

a housing having a base and an upper exhaust end for forming a plenum which conducts a flow of hot flue gas from a burner positioned adjacent the housing's base;

a heat exchanger residing within the plenum and forming an annular space therebetween through which hot flue gases flow upwardly to the exhaust end;

an inlet adjacent the top of the heat exchanger;

an outlet adjacent the bottom of the heat exchanger so that the liquid flows downwardly and countercurrent to the hot flue gas and is heated before being discharged from the heat exchanger;

an annular jacket having inner and outer walls which are closed at a lower and an upper end and forming an annular cross-sectional space therebetween, the inner wall forming the housing and which is in heat conductive communication with the hot flue gases in the plenum;

an inlet at the jacket's lower end for admitting feed liquid to the jacket; and an outlet at the jacket's upper end so that liquid can flow form the inlet to the outlet and be preheated through the inner wall before the preheated liquid is conducted from the jacket to the inlet to the heat exchanger.

20. The heater of claim 19 comprising one or more annular plates located transverse across the annular space for partially distributing the hot flue gas about the heat exchanger as they pass upwardly by the one or more annular plates.

* * * * *